US008534212B1

(12) United States Patent
Worsley et al.

(10) Patent No.: US 8,534,212 B1
(45) Date of Patent: Sep. 17, 2013

(54) PONTOON BOAT FENDER AND METHOD OF USING THE SAME

(75) Inventors: Michael Brian Worsley, Washington, NC (US); James E. Cotter, Ashland, OH (US)

(73) Assignee: Overton's, Inc., Greenville, NC (US)

( * ) Notice: Subject to any disclaimer, the term of this patent is extended or adjusted under 35 U.S.C. 154(b) by 381 days.

(21) Appl. No.: 12/955,152

(22) Filed: Nov. 29, 2010

(51) Int. Cl.
*B63B 59/02* (2006.01)

(52) U.S. Cl.
USPC ..... 114/219; 114/343; 114/364

(58) Field of Classification Search
USPC ..... 114/219, 343, 364
See application file for complete search history.

(56) References Cited

U.S. PATENT DOCUMENTS

| | | | | |
|---|---|---|---|---|
| 3,286,680 | A | 11/1966 | Caretta | |
| D219,893 | S | 2/1971 | Simpton | |
| 4,773,348 | A * | 9/1988 | Rowley | 114/219 |
| 4,788,926 | A | 12/1988 | Ullman et al. | |
| 5,671,692 | A | 9/1997 | Kimball | |
| 5,988,087 | A * | 11/1999 | Pepper | 114/61.1 |
| 6,021,729 | A | 2/2000 | DeRuscio | |
| 6,758,155 | B1 * | 7/2004 | Nicholas | 114/219 |
| 6,758,156 | B1 | 7/2004 | Kobas | |
| 6,863,011 | B2 | 3/2005 | Kinkead | |
| 6,951,181 | B1 | 10/2005 | Lemke | |
| 6,983,711 | B1 | 1/2006 | Lemke | |
| 2004/0221788 | A1 * | 11/2004 | Sievewright | 114/219 |

* cited by examiner

*Primary Examiner* — Edwin Swinehart
(74) *Attorney, Agent, or Firm* — Thompson Coburn LLP

(57) ABSTRACT

A pontoon boat fender comprises a shell portion with a hollow interior and a bumper portion slidably received in the shell portion hollow interior. The bumper portion is movable between a navigating position and a docking position. In the navigating position, the bumper portion is retracted into the shell portion hollow interior. In the docking position, the bumper portion is extended from the shell portion hollow interior. The shell portion has a tab adjacent to a longitudinal end of the shell portion and a hook adjacent to a longitudinally opposite end of the shell portion. The tab and hook cooperate with each other to enable securing the boat fender to a fence and deck of the pontoon boat.

24 Claims, 5 Drawing Sheets

PONTOON BOAT FENDER AND METHOD OF USING THE SAME

BACKGROUND

The present disclosure is directed to a pontoon boat fender with a fence guard portion that protects a fence upstanding from a deck of a pontoon boat at a peripheral edge of the pontoon boat deck and a bumper or pontoon guard portion that is moveable between an extended position that overlies and protects at least a portion of the pontoon of the pontoon boat in a docking mode and retracted position that exposes the pontoon of the pontoon boat and allows for the navigation of the pontoon boat.

DETAILED DESCRIPTION

Figure 1:
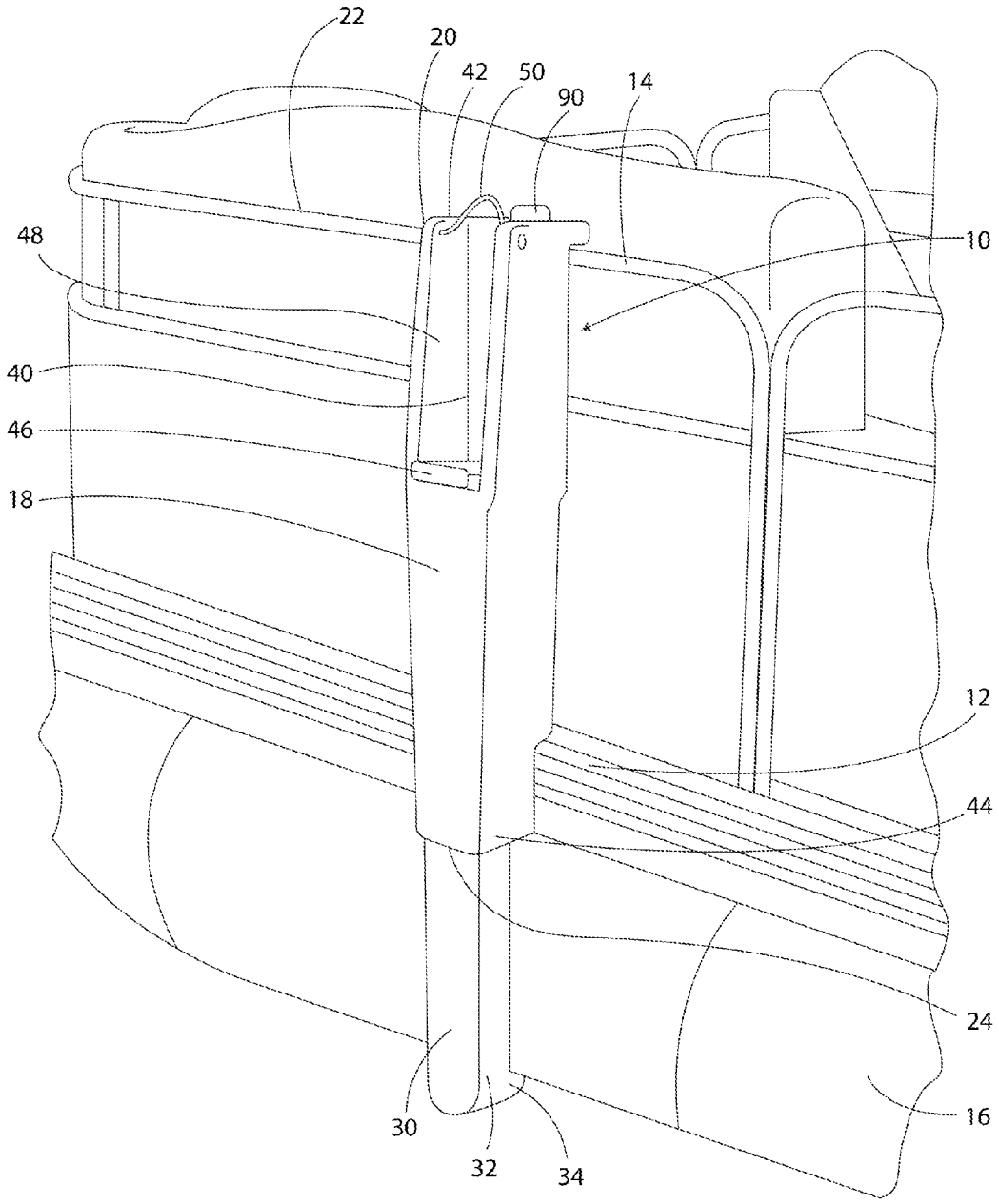
FIG. 1 shows a perspective view of a pontoon boat fender mounted to a pontoon boat.
Figure 2:
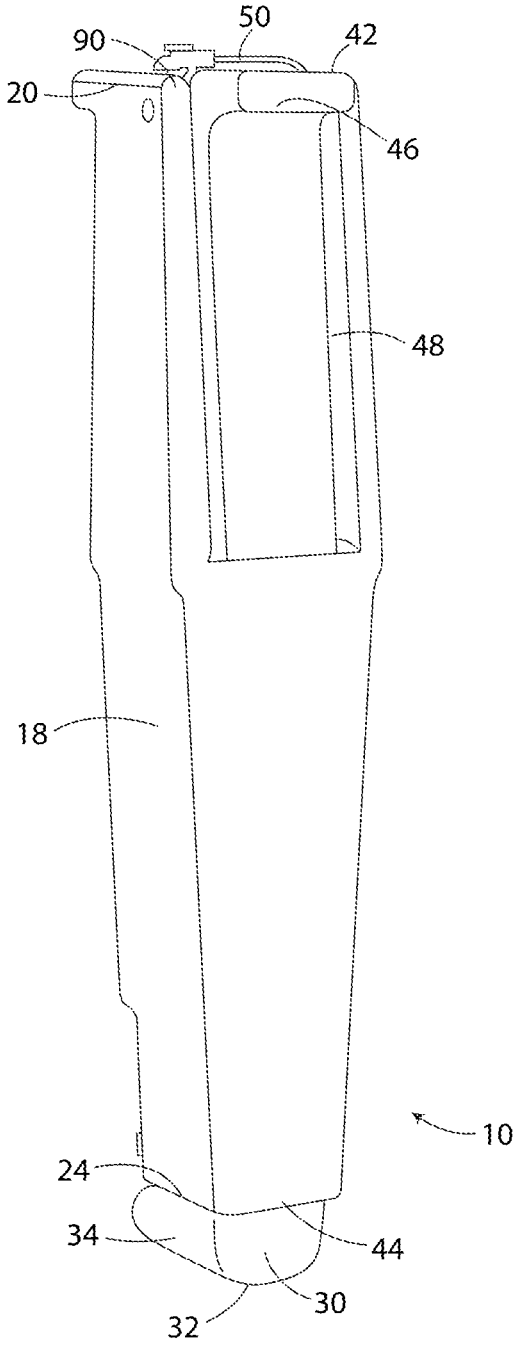
FIG. 2 is a perspective view of the pontoon boat fender of FIG. 1 with the bumper or pontoon guard portion shown in a retracted position.
Figure 3:
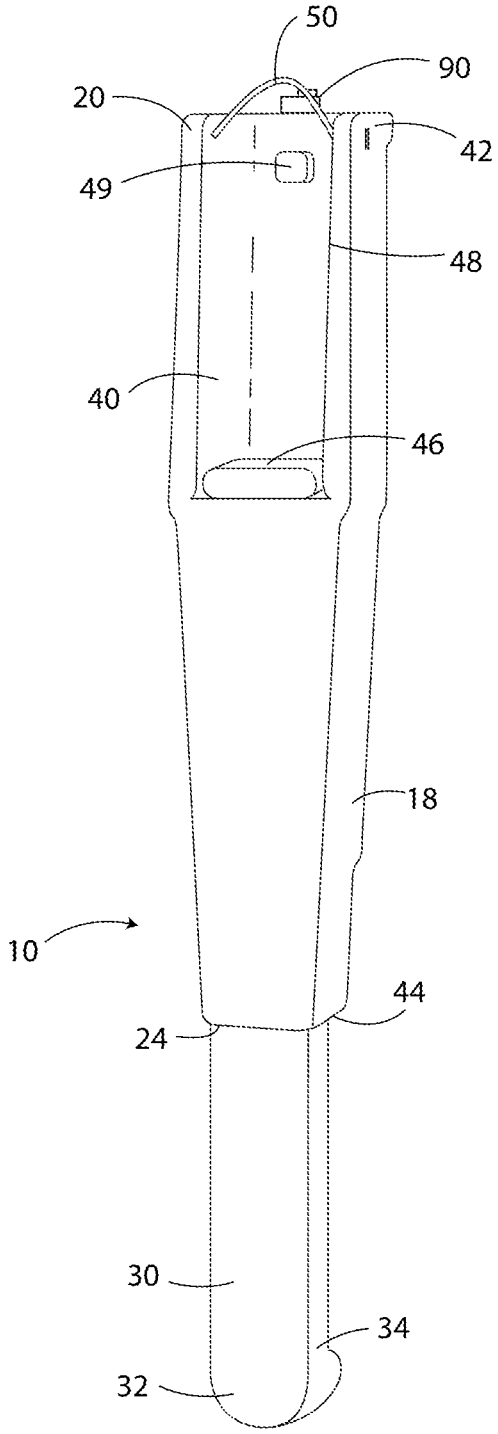
FIG. 3 is a perspective view of a pontoon boat fender of FIG. 1 with the bumper or pontoon guard portion of the pontoon fender shown in an extended position.

FIG. 1 shows a perspective view of a pontoon boat fender 10. The pontoon boat fender 10 is adapted to be releasably mounted to a pontoon boat, so the fender may be deployed as necessary when the boat is in use or stowed as necessary when the boat is not in use, as may be desired. Preferably, the pontoon boat fender 10 is releasably mounted between a deck 12 of the pontoon boat and a fence 14 extending around a periphery of the pontoon boat deck. As shown in FIG. 1, the pontoon boat fence 14 extends upwardly and generally vertically from the deck 12 around the outer periphery of the deck. In this position, the pontoon boat fender 10 may be mounted on the outboard side of the pontoon boat to protect the fence and a pontoon 16 below the deck as will become evident from the discussion that follows. In view of the marine environment, the pontoon fender is preferably made from polyvinyl materials to withstand the elements and provide cushioning. For instance, the pontoon boat fender may be made from a polyethylene material with a soft inner core of PVC to absorb impact. The pontoon boat fender may also be made from a vinyl material with a soft PVC core to absorb impact.

Referring to FIG. 1, the pontoon boat fender 10 preferably comprises a fence guard portion 18 that is adapted to be mounted on the pontoon boat. When the pontoon boat fender is mounted to the fence as shown in FIG. 1, the fence guard portion 18 is in position to protect at least a portion of the fence when the pontoon boat is brought alongside another object or is in a docked position. Preferably, the fence guard portion 18 has a length that is dimensioned to accommodate a height of the fence 14 and a thickness of the deck 12 and its associated structure. Preferably, the fence guard portion 18 overlies at least a portion of the fence, and when the pontoon boat fender is mounted to the fence, a proximal end 20 of the fence guard portion is generally adjacent to a top of the fence 22, and a distal end 24 of the fence guard portion is generally adjacent to the deck 12 of the pontoon boat.

The pontoon boat fender 10 also comprises a bumper or pontoon guard portion 30 that is operatively coupled to the fence guard portion. The bumper or pontoon guard portion 30 is preferably movable relative to the fence guard portion 18 between a docking or extended position and a navigating or retracted position. In the docking or extended position, the bumper or pontoon guard portion 30 is extended away from the fence guard portion 18 such that a distal end 32 of the pontoon guard portion may be spaced from the distal end 24 of the fence guard portion and the bumper or pontoon guard portion may be positioned to overlie a portion of the pontoon 16. With the bumper or pontoon guard portion 30 overlying the outboard portion of the pontoon 16, the bumper or pontoon guard portion may be positioned to protect at least a portion of the pontoon from impact from objects alongside the pontoon boat. The distal end 32 of the bumper or pontoon guard portion may be provided with an inboard tab 34 to engage the underside curvature of the pontoon. In the navigating or retracted position, the bumper or pontoon guard portion 30 is retracted toward the fence guard portion 18 such that the bumper or pontoon guard distal end 32 is adjacent to the fence guard portion distal end 24. This allows the boat to be navigated without the bumper or pontoon guard portion being subjected to waves or a wake action generated by the pontoon during underway motion of the pontoon boat. Because the pontoon guard portion 30 may be moved between the docking or extended position and the navigating or retracted position, the pontoon boat fender may be mounted to the pontoon boat and ready for use in either position or mode as necessary depending upon whether the user is navigating or docking.

The fence guard portion 18 may comprise a shell with a hollow interior 40. The fence guard portion may have an opening 42 at its proximal end and an opening 44 at its distal end both leading into the hollow interior. The bumper or pontoon guard portion 30 may be received in the hollow interior 40 of the shell in a manner to permit reciprocal sliding motion of the bumper or pontoon guard portion 30 in the hollow interior relative to the fence guard portion 18 between the docking or extended position and the navigating or retracted position. The bumper or pontoon guard portion 30 may also be provided with a handle 46 at its proximal end to allow operation of the bumper or pontoon guard portion within the hollow interior of the shell. A slot 48 may provided in the fence guard portion to accommodate and/or allow access to the handle to facilitate operation of the bumper or pontoon guard portion within the hollow interior of the shell. The handle 46 may project from the slot 48 a distance to enable the handle to function as a lower stop to limit downward motion of the bumper or pontoon guard portion. An upper stop 49 may be provided in the hollow interior 40 adjacent the fence guard portion proximal end opening 42 to limit outward motion of the bumper or pontoon guard portion 30.

To maintain the bumper or pontoon guard portion 30 in a desired position relative to the fence guard portion 18, an elastic locking band 50 may be provided. The locking band 50 may be arranged on the fender to cooperate with the bumper or fence guard portion to hold the bumper in position. For instance, as shown in the figures, the locking band 50 may be used to hold the bumper or pontoon guard portion 30 against the upper stop 49 in the navigating position. However, the locking band 50 may also be used to maintain the bumper in the docking position. Preferably, the elastic locking band 50 is arranged across the slot 48 of the fence guard portion and cooperates with the handle 46. More preferably, the elastic locking band cooperates with the handle to maintain the bumper portion in the navigating position.

Figure 4:
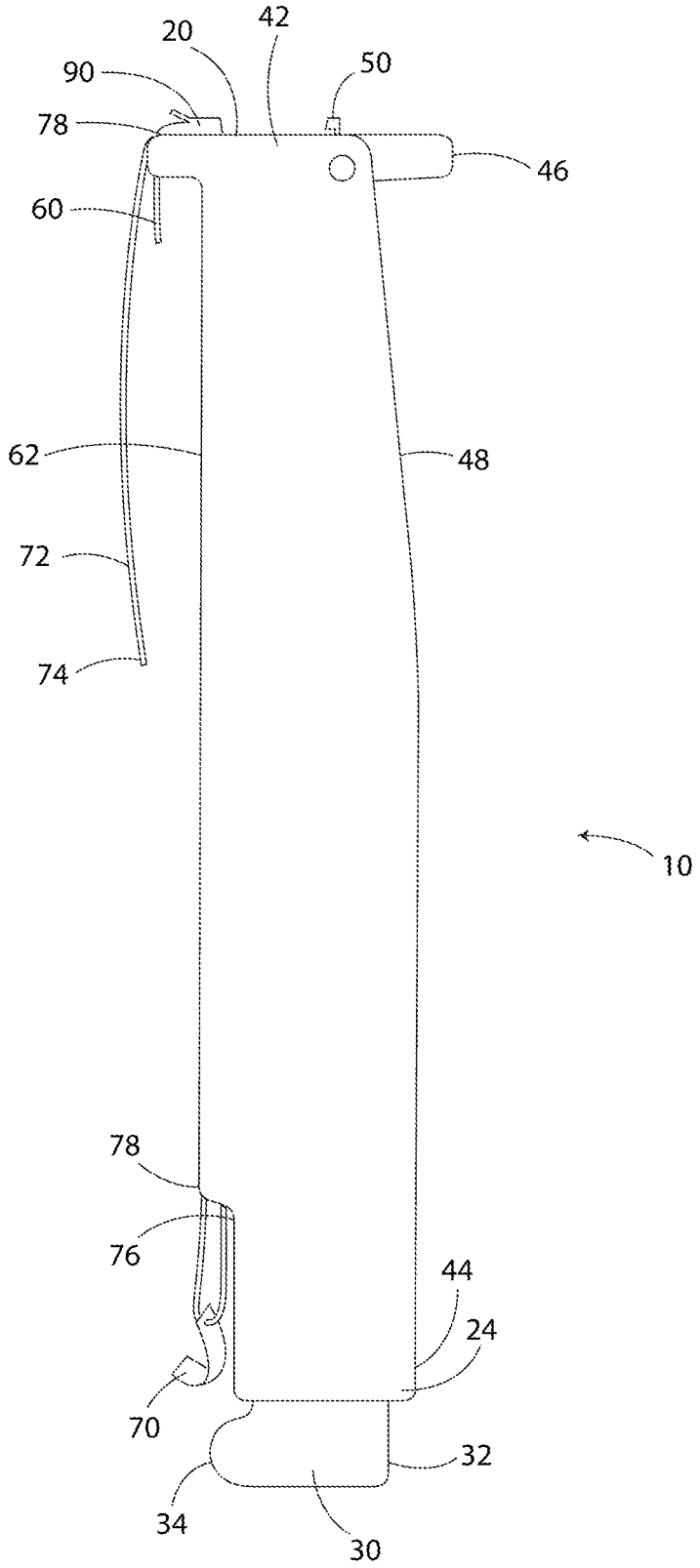
FIG. 4 is a side view of the pontoon boat fender of FIG. 1 with the bumper or pontoon guard portion shown in a retracted position.
Figure 5:
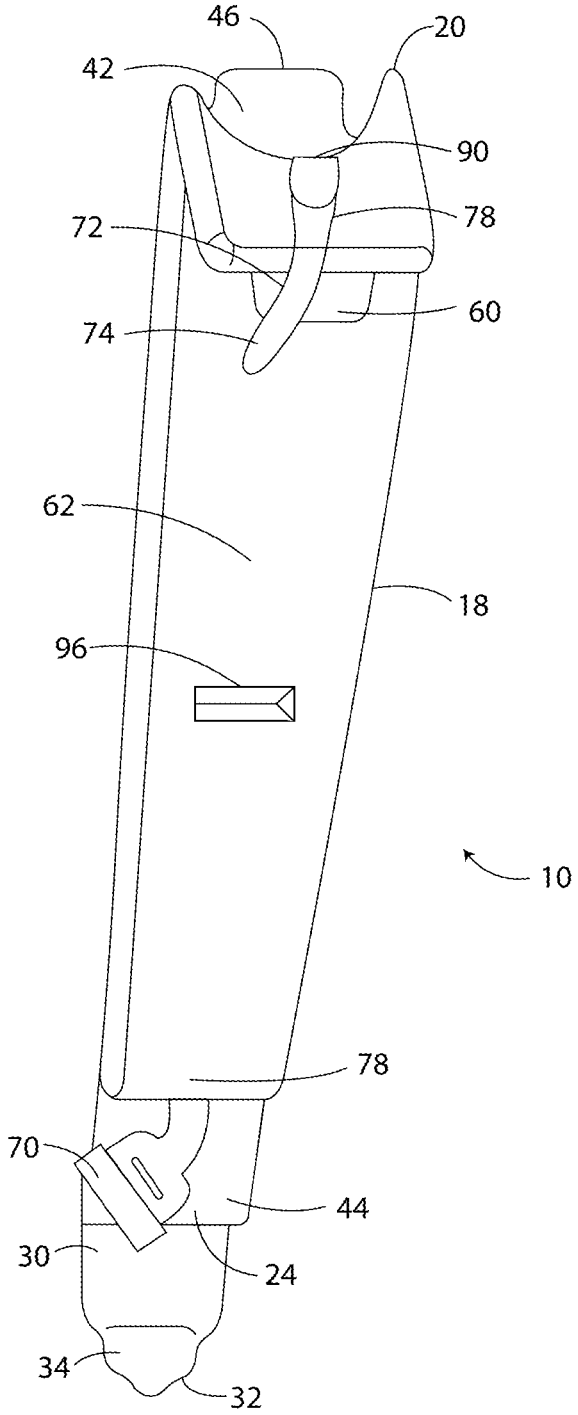
FIG. 5 is a rear perspective view of the pontoon boat fender with the bumper or pontoon guard portion shown in a position between the retracted position and the extended position.

Referring specifically to FIG. 4, the fence guard portion 18 is provided with a tab 60 at its proximal end 20. Preferably, the tab 60 allows the proximal end 20 of the fence guard portion to be attached to the fence 12 (FIG. 1). The tab 60 is spaced from a back surface 62 of the fence guard portion 18 to enable the fence guard portion to be attached around the fence. Typically, the fence is one inch square tubing. The spacing of the tab 60 accommodates this geometry, although another spacing arrangement may be used depending upon the geometry of the fence.

Specifically referring to FIG. 4, the fence guard portion 18 has a hook 70 operatively connected to the distal end 24 of the fence guard portion. The hook 70 cooperates with the tab 60 to allow releasably mounting of the pontoon boat fender to the pontoon boat. Preferably, the hook 70 engages the underside of the deck structure 12 (FIG. 1), although the hook may be positioned to engage another portion of the boat structure or fence structure. Preferably, the hook 70 is positioned on an adjustment strap 72 so that the hook is movable relative to the tab 60 to allow adjustably mounting and unmounting of the fender as desired depending upon boat style, fence height, deck thickness, deck structure, and other mounting structure variables. The strap has a proximal end 74 that may be grasped by the user, for instance, when pulling the strap to secure the fender on the boat. The strap has a distal end 76 that may be fixed to the fence guard portion adjacent to the distal end 24 of the fence guard portion. Preferably, the strap 72 extends through a slot 78 within the fence guard portion 18 that extends from the distal end 24 of the fence guard portion to the proximal end 20 of the fence guard portion. This allows the hook 70 to freely slide along the adjustment strap 72 and be supported by the adjustment strap in a position below the adjustment strap and adjacent to the distal end 24 of the fence guard portion in the same relative plane as the tab. This in turn enables the pontoon fender to be mounted in a generally vertical plane parallel to the fence. The adjustment strap preferably has a length allowing the pontoon fender to be used with a variety of fence heights and pontoon boats manufactured by different manufacturers. Although the hook is shown in the figures as attached to the strap, in addition to, or in the alternative, the tab may be attached to a strap with a similar arrangement to that shown in the drawings.

After exiting the slot 78 toward the proximal end 20 of the fence guard portion, the adjustment strap 72 may be directed through a buckle 90 to releasably engage the adjustment strap along its length as desired to releasably secure the pontoon fender between the deck and top of the fence. The buckle may comprise a cam operated lever that frictionally engages the adjustment strap in a locked position and releases the strap in an unlocked position. Preferably, the buckle 90 is provided at the fence guard proximal end 20 for ease of use, although the buckle may be provided in another area of the fence guard portion. In the alternative to a buckle, the strap may be tightened against the fence guard portion using other mechanical means, for instance, a hook and loop fastener system to releasably engage the strap to the fence guard portion. Although the strap as shown is inextendable once fastened with the buckle, the strap may also be formed from an elastic material, i.e., bungee cords or elastic bands, to secure the pontoon boat fender to the fence. A handle 96 may be provided on fence guard portion back surface 62 to aid in maneuvering the fender.

To attach the pontoon boat fender to the pontoon boat, the user operates the buckle 90 to loosen the strap 72 and lower the hook 70. Then the user lifts the fender over the side of the fence and engages the tab 60 between the top 22 of the fence and the seat cushion. The user then preferably engages the underside of the deck with the hook 70 and pulls up on the strap 72 to securely engage the hook on the underside of the deck 12. The user then engages the buckle 90 to secure the strap in position. At this point, the fence guard portion 18 overlies the outboard portion of the fence 14 and protects the fence structure of the boat from dock structures or other objects alongside the boat. The locking band 50 may then be released from the handle 46 and handle may be pushed downward to place the bumper or pontoon guard portion 30 in the docking or extended position. At this point the bumper or pontoon guard portion 30 overlies the outboard side of the pontoon 16 and protects the pontoon from dock structures or other objects alongside the boat. To the remove the fender, the user performs the steps in reverse order. The handle 46 is lifted upward to move the bumper or pontoon guard portion 30 to the navigating or retracted position and the locking band 50 is manipulated to engage the handle. Next, the user lifts up on the buckle 90 to release the strap, and holding onto the boat fender, the user lifts upward an amount that is sufficient to release the hook 70 from the underside of the deck 12 when the fender is moved back downward. Once the hook is disengaged from the deck, the boat fender may be pulled over the side of the fence and placed on the deck.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed were meant to be illustrative only and not limited as to the scope of the invention which is to be given the full breadth of the appended claims and any equivalents thereof.

What is claimed is:

1. A pontoon boat fender comprising:

a shell portion with a hollow interior and a bumper portion slidably received in the shell portion hollow interior, the bumper portion being movable between a navigating position and docking position, wherein the navigating position the bumper portion is retracted into the shell portion hollow interior and wherein the docking position the bumper portion is extended from the shell portion hollow interior, the shell portion having a tab adjacent to a longitudinal end of the shell portion and a hook adjacent to a longitudinally opposite end of the shell portion, the tab and hook cooperating with each other to enable securing the boat fender to a fence and a deck of a pontoon boat.

2. The fender of claim 1 wherein the hook is adjustably positionable relative to the shell portion.

3. The fender of claim 1 further comprising an adjustment strap releasably engagable with the shell portion along a length of the adjustment strap.

4. The fender of claim 3, wherein the hook is operatively connected to the adjustment strap.

5. The fender of claim 3 further comprising a buckle for releasably engaging the adjustment strap to the shell portion.

6. The fender of claim 1, wherein the bumper portion comprises a handle extending from the shell portion hollow interior.

7. The fender of claim 6, wherein the shell portion comprises a slot that opens to the hollow interior and the bumper portion handle projects from the slot.

8. The fender of claim 7, further comprising a locking band extending across the shell portion slot in a position to engage the bumper portion handle to maintain the bumper portion in the navigating position.

9. A pontoon boat fender comprising:

a fence guard portion adapted to be mounted on a pontoon boat to overlie a portion of a fence extending around the peripheral edge of a deck of a pontoon boat, the fence guard portion having a proximal end positionable adjacent to a top of the fence and a distal end positionable adjacent to the deck; and a pontoon guard portion operatively coupled to the fence guard portion, the pontoon guard portion being moveable relative to the fence guard portion between a docking position wherein a distal end of the pontoon guard portion is positioned away from the fence guard portion distal end and a navigating position in which the pontoon guard portion distal end is positioned adjacent to the fence guard portion distal end;

wherein in the docking position, the pontoon guard portion overlies at least a portion of a pontoon of a pontoon boat when the fence guard portion is mounted to the pontoon boat; and further comprising a locking band attached to the fence guard portion engageable with the pontoon guard portion to maintain the pontoon guard portion in the navigating position.

10. The fender of claim 9, wherein the fence guard portion proximal end has a tab adapted to allow mounting the fence guard portion to a top of the fence.

11. The fender of claim 9, further comprising a hook adjacent the fence guard portion distal end adapted to engage the deck.

12. The fender of claim 11, wherein the hook is adjustably positionable relative to fence guard portion.

13. The fender of claim 9, further comprising an adjustment strap releasably engagable with the fence guard portion along a length of the adjustment strap.

14. The fender of claim 13, further comprising a hook operatively connected to the adjustment strap.

15. The fender of claim 13, further comprising a buckle for releasably engaging the adjustment strap to the fence guard portion.

16. The fender of claim 15, wherein the buckle is adjacent the fence guard portion proximal end.

17. The fender of claim 9, wherein the fence guard portion has a hollow interior that slidingly receives the pontoon guard portion.

18. A pontoon boat fender comprising:

a fence guard portion adapted to be mounted on a pontoon boat to overlie a portion of a fence extending around the peripheral edge of a deck of a pontoon boat, the fence guard portion having a proximal end positionable adjacent to a top of the fence and a distal end positionable adjacent to the deck; and a pontoon guard portion operatively coupled to the fence guard portion, the pontoon guard portion being moveable relative to the fence guard portion between a docking position wherein a distal end of the pontoon guard portion is positioned away from the fence guard portion distal end and a navigating position in which the pontoon guard portion distal end is positioned adjacent to the fence guard portion distal end;

wherein in the docking position, the pontoon guard portion overlies at least a portion of a pontoon of a pontoon boat when the fence guard portion is mounted to the pontoon boat wherein the fence guard portion has a hollow interior that slidingly receives the pontoon guard portion; and wherein the fence guard portion comprises a slot that opens to the hollow interior and a handle of the pontoon guard portion extends from the slot.

19. The fender of claim 18, further comprising a locking band extending across the fence guard portion slot in a position to engage the pontoon guard portion handle to maintain the pontoon guard portion in the navigating position.

20. A method of using a pontoon boat fender, the method comprising:

accessing a fender for a pontoon boat wherein the fender has a fence guard portion and a pontoon guard portion operatively connected with the fence guard portion, the fence guard portion and pontoon guard portions having respective distal ends, the pontoon guard portion being movable relative to the fence guard portion between a docking position wherein the pontoon guard portion distal end is positioned away from the fence guard portion distal end and a navigating position in which the pontoon guard portion distal end is positioned adjacent to the fence guard portion distal end;

with a tab provided adjacent to the fence guard portion proximal end, engaging a fence of the pontoon boat;

with a hook provided adjacent to the fence guard portion distal end, engaging a deck of the pontoon boat;

releasably securing the fender to the pontoon boat in a manner such that the fence guard portion overlies a portion of a fence extending around the peripheral edge of the deck of the pontoon boat with the pontoon guard portion being positionable to the docking position to overlie at least a portion of a pontoon of a pontoon boat;

wherein the step of releasably securing the fender to the pontoon boat further comprises positioning the hook with an adjustment strap that is releasably engagable with the fence guard portion along a length of the adjustment strap.

21. The method of claim 20, further comprising actuating a buckle in releasably engaging the adjustment strap to the fence guard portion.

22. The method of claim 21, wherein the buckle is adjacent to the fence guard portion proximal end.

23. The method of claim 20 further comprising, with a locking band attached to the fence guard portion, releasably engaging the pontoon guard portion to maintain the pontoon guard portion in the navigating position.

24. The method of claim 20 further comprising, with a handle of the pontoon guard portion, moving the pontoon guard portion relative to the fence guard portion between a docking position wherein the pontoon guard portion distal end is positioned away from the fence guard portion distal end and a navigating position in which the pontoon guard portion distal end is positioned adjacent the fence guard portion distal end.

* * * * *